United States Patent [19]

Lunquist et al.

[11] 4,383,648

[45] May 17, 1983

[54] TORCH APPARATUS

[75] Inventors: Frank C. Lunquist, New Brighton; Frank T. Kawamoto, Minneapolis, both of Minn.

[73] Assignee: Tescom Corporation, Minneapolis, Minn.

[21] Appl. No.: 325,971

[22] Filed: Nov. 30, 1981

[51] Int. Cl.[3] ..... F23D 11/16

[52] U.S. Cl. ..... 239/419.3; 239/422; 239/424.5

[58] Field of Search ..... 239/419.3, 422, 424.5, 239/552, 600, 419

[56] References Cited

U.S. PATENT DOCUMENTS

| | | | |
|---|---|---|---|
| 1,297,053 | 3/1919 | Anderson | 239/552 X |
| 1,940,111 | 12/1933 | Austin | 239/552 X |
| 2,496,923 | 2/1950 | Walters et al. | 239/552 X |
| 2,519,939 | 8/1950 | Smith | 239/419 X |
| 2,531,006 | 11/1950 | Smith | 239/552 |
| 2,552,873 | 5/1951 | Smith | 239/419 |
| 3,643,871 | 2/1972 | Hamernik et al. | 239/419.3 |
| 3,847,355 | 11/1974 | Smith | 239/424.5 |

*Primary Examiner*—John J. Love

*Assistant Examiner*—Gene A. Church

*Attorney, Agent, or Firm*—Clayton R. Johnson

[57] ABSTRACT

Torch apparatus for cutting, heating or welding that includes torch head having a torch bore; a torch tip assembly having a tip member that includes a stem portion extending between the head bore with its cutting oxygen passageway opening to the head cutting oxygen passageway and a front member portion joined to the stem portion to extend away from the head, and a barrel retained on the stem portion by a nut in abutting relationship with the front member portion, said barrel having preheat oxygen and fuel gas bores opening into barrel grooves which in cooperation with the stem portion provide passages to mix the preheat oxygen and fuel gas and conduct the mixture to an annular clearance space that in turn opens to the front member mixed gas passageways; a collar on the tip member and a nut threaded on the head to abut against the collar and thereby hold the tip assembly in an assembled relationship to the torch head.

In the first embodiment the stem portion and front portion are formed as separate parts while in the second embodiment they are formed as a single part.

15 Claims, 5 Drawing Figures

TORCH APPARATUS

BACKGROUND OF THE INVENTION

Torch apparatus that incudes a torch head and a torch tip assembly made up of a plurality of parts that is mountable on the torch head.

In the prior art it is old to provide single piece torch tips wherein the cutting oxygen passageway extends the axial length of the tip and the preheat oxygen and fuel gas passageways extend the entire length of the tip or the length of the part of the tip that extends forwardly of the torch head plus a major portion of the length of the tip that extends within the torch head bore, for example see U.S. Pat. Nos. 2,258,340 and 2,702,079. However such tips are relatively expensive to produce, in part due to the axial length of the passageways that are drilled therein, and do not have the flashback resistance that is desired.

Further it is old to provide two piece torch tip assemblies that include a mixer piece that is substantially entirely located in the torch head bore and a torch tip having a generally planar face abutting against a generally planar face of the mixer, for example see U.S. Pat. No. 3,643,871.

A different type of a two piece torch tip is one that has a tip shell and an insert removably extended into the shell, for example see U.S. Pat. No. 2,531,006. In U.S. Pat. No. 2,519,939 there is disclosed a tip assembly that includes a torch tip that has a cylindrical portion removably extended through a bushing threaded into the torch head bore, the bushing having preheat oxygen passageways extending axially therethrough.

In order to make an improved torch tip assembly for cutting, heating and welding torches with improved flashback resistance and improved combustion of preheat flames as demonstrated by a more even color and a more even preheat flame height at a lower manufactured cost, this invention has been made.

SUMMARY OF THE INVENTION

A torch tip assembly that is mountable in a bore of the torch head of a welding, cutting or heating torch and includes a tip member having a cutting oxygen passageway extended axially therethrough, the tip member including a front member portion having a front surface, a rear surface and mixed gas passageways extending axially therethrough, and a stem portion joined to the front portion to extend axially rearwardly thereof, and a barrel removably mounted on the stem portion, at least one of the stem portion and the barrel having axially elongated grooves opening to the other to define passages for conducting fuel gas and preheat oxygen, and a cut-out in at least one of the stem portion, the front member portion and the barrel for placing the grooves in fluid communication with the mixed gas passageways.

One of the objects of this invention is to provide a new and novel torch tip assembly that has good flashback resistance. Another object of this invention is to provide a new and novel torch tip assembly that is relatively easy to manufacture and is relatively inexpensive.

BRIEF DESCRIPTION OF THE DRAWINGS

Referring now to FIGS. 1–4, the first embodiment of the torch apparatus of this invention, generally designated 10, includes a torch head 11 having a torch bore 12 opening through the front surface thereof, a cutting oxygen passageway 13 having a cutting oxygen conduit 14 seated in an end thereof and opening thereto and an opposite end opening to the radially central portion of one end of bore 12; a preheat oxygen passageway 15 having a preheat oxygen conduit 16 seated in one end thereof and opening thereto and at the other end opening through the circumferential wall of the torch head bore; and a fuel gas passageway 17 having one end of a fuel gas conduit 18 seated therein and opening thereto and at the other end opening through the circumferential wall of bore 12 at a substantially greater axial distance from the opening of the cutting oxygen passageway 13 to bore 12 than the preheat oxygen passageway.

Figure 1:
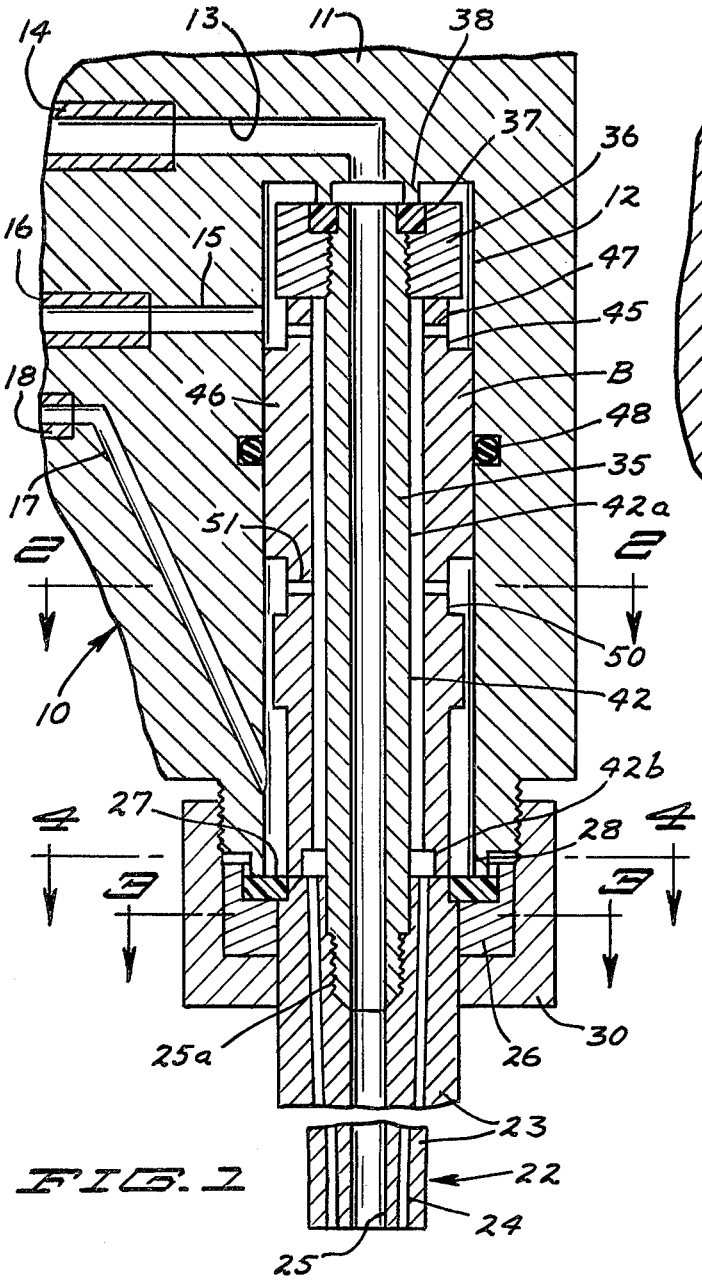
FIG. 1 is a fragmentary axial cross-sectional view through the torch head and torch tip assembly of the first embodiment of the invention.

Mounted in bore 12 to extend forwardly thereof is a torch tip assembly, generally designated 22. The tip assembly 22 includes a tip front member portion 23 having a central cutting oxygen passageway 25 extending axially therethrough and a plurality of circumferentially spaced mixed gas passageways 24 that extend axially therethrough and are radially spaced from passageway 25. A collar 26 is crimped and/or brazed on (or may be integrally formed with) the rear portion of front member portion 23 to in conjunction therewith provide an annular recess in which there is located sealing material 27 to form a fluid seal with the reduced diameter, front annular flange 28 of the head. A head nut 30 has an annular surface abutting against collar 26 and a threaded portion to be threaded onto the torch head to through the collar retain seal 27 in sealing relationship with flange 28.

The rear part of the cutting oxygen bore of the tip front member portion defines a stem portion receiving socket that includes an enlarged diametric rear part and a front threaded part **25*a* that in conjunction with the rear part forms a rearwardly facing annular shoulder to have a front shoulder on the axially elongated tip stem portion 35 abut thereagainst when the front end portion of the tip stem portion is threaded into threaded bore 25*a*. The opposite end portion of the tip stem portion is threaded to have a nut 36 threaded thereon. The rear end of the tip stem and nut 36 cooperatively provide an annular groove mounting sealing material or O-ring 37 to form a fluid seal with an annular boss 38 of the torch head at the end of the bore 12 through which passageway 13** opens and a fluid seal between the nut and tip stem portion.

Figure 2:
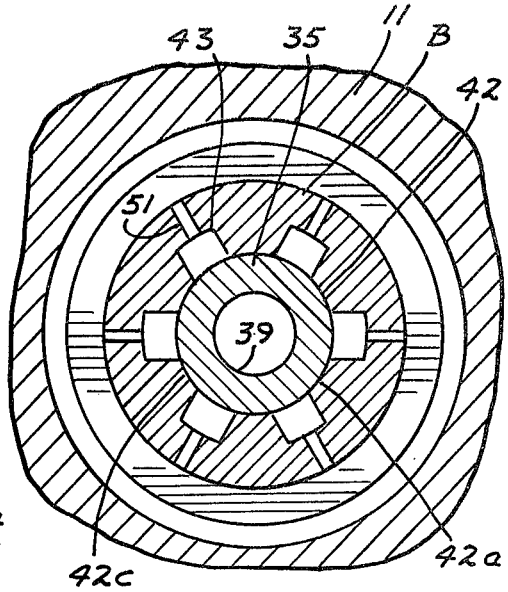
FIG. 2 is a fragmentary transverse cross-sectional view of the tip stem portion, barrel and the adjacent part of the torch head, said view being generally taken along the line and in the direction of the arrows 2—2 of FIG. 1.
Figure 3:
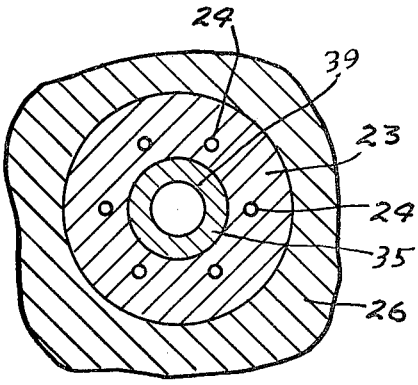
FIG. 3 is a fragmentary transverse cross-sectional view generally taken along the line and in the direction of the arrows 3—3 of FIG. 1 to further illustrate the construction of the tip stem and tip front member portions.
Figure 4:
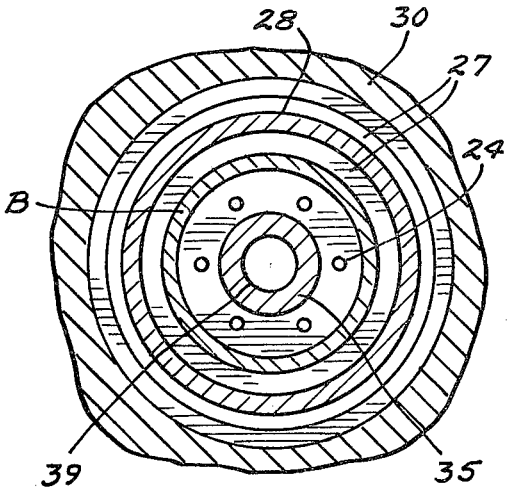
FIG. 4 is a fragmentary cross-sectional view generally taken along the line and in the direction of the arrows 4—4 of FIG. 1.

The tip stem portion has a cutting oxygen bore 39 extending axially therethrough to have the front end thereof open to the tip front member bore 25 forwardly of threaded portion 25*a* and have the rear end thereof open through the part of bore 12 surrounded by boss 38 to therethrough open to passageway 13. The major portion of the length of the step portion has a circular cylindrical outer circumferential surface. The cylindrical surface extends axially from the annular shoulder of the stem portion against which the nut abuts to the front annular shoulder that is adjacent the part of the stem portion that is threaded into bore portion 25*a*. As may be noted from FIGS. 1 and 2 the mixed gas passageways 24 of the tip front member portion are located radially outwardly of the axially adjacent parts of the tip stem portion.

Located in the head bore 12 and extending in circumferentially surrounding relationship to the tip stem portion axially from nut 36 to the rear surface of the tip front member portion is a tip barrel B. The barrel B has a circular cylindrical bore 42 extending axially therethrough and a plurality of circumferentially spaced flutes or grooves 43 opening to bore 42. The bore 42 has a bore portion 42*a* that opens through the rear planar surface of the barrel, extends nearly the entire axial length of the barrel, and opens to an enlarged diametric bore portion (cut-out) 42*b* which in turn opens through the front planar surface of the barrel. The barrel front planar surface abuts against the rear planar surface of the tip front member portion with bore portion 42*b* opening to the mixed gas fluid passageway 24 radially between the tip stem portion and the inner circumferential wall portion of the barrel that in part defines bore portion 42*b*. The grooves 43 open to bore portion 42*b*, the radial dimension of the annular surface formed by the opening of bore portion 42*a* to bore portion 42*b* being greater than the corresponding dimension of a groove. The barrel has an inner peripheral wall that has arcuate surface portion 42*c* that in part defines bore portion 42*a*, extend arcuately between adjacent grooves 43, and extend the axial length of bore portion 42*a*. Surface portions 42*c* form a close fit with the outer cyindrical surface of the tip stem portion. The wall portions defining grooves 42 in conjunction with the wall portions of the stem portion to which then open cooperatively define gas passages.

The axial rear portion 45 of the barrel is of a reduced outer diameter, portion 45 being axially next to portion 46 which is of an outer diameter to form a close removable fit with the circumferential wall defining bore 12. A cross bore 47 is provided in the barrel for each groove 43 to open thereto, the cross bores opening through the outer surface of portion 45. The preheat oxygen passageway 15 opens to bore 12 at the annular clearance space between barrel portion 45 and the cylindrical wall defining bore 12, this clearance space being axially between barrel portion 46 and seal 37.

The portions of the barrel axially forwardly of portion 46 are of smaller outer diameters than the diameter of portion 46 to provide a second annular clearance space between the barrel and the circumferential wall defining bore 12. The fuel gas passageway opens to this second clearance space axially between seal 27 and portion 46. The second clearance space is in part defined by barrel portion 50 which is of a substantially smaller outer diameter than barrel portion 46. For each groove 43 there is provided a cross bore 51 that opens through the outer circumferential surface of barrel portion 50 and to the respective groove for conducting fuel gas from the second clearance space to the respective groove 43. The cross bores 51 are substantially axially spaced from cross bores 47 and from bore portion 42*b*, and are axially therebetween. An annular groove is provided in the torch head for mounting an O-ring 48 to provide a fluid seal between barrel portion 46 and the torch head.

When the torch tip assembly is in proper assembled relationship in the torch head, the stem portion is threaded and/or brazed into the front member portion to form a fluid seal therebetween with bore 25 in fluid communication with bore 39. Further, nut 36 is threaded onto the stem portion to hold the barrel in fluid sealing relationship with the front member rear surface and bore portion 42*b* in fluid communication with passageways 24. Further, nut 30 is tightened so that seal 27 provides a fluid seal between the tip front member portion, collar 26 and the torch head, and seal 37 forms a fluid seal between boss 38, nut 36 and barrel 35. With reference thereto the outer diameter of the rear part of the stem portion is less than the inside diameter of boss 38.

Figure 5:
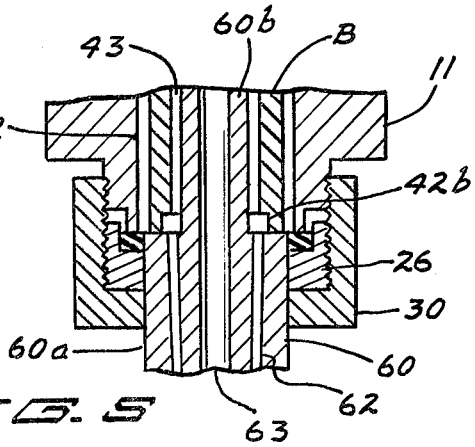
FIG. 5 is a fragmentary axial cross-sectional view through the torch head and torch tip assembly of the second embodiment of the invention.

Referring to FIG. 5, the second embodiment of the inventory, generally designated 60, is of the same construction as the first embodiment other than the tip front member and tip stem portions are formed as a single integral part rather than as two parts. That is the second embodiment includes a tip member 60 having a front member portion 60*a* and a stem portion 60*b* integrally joined to the front member portion to extend rearwardly thereof into the torch head bore 12. The barrel B circumferentially surrounds the stem portion and is retained in abutting relationship with the transverse annular planar rear surface of the front member portion at the juncture of the front member and stem portions by a nut 36 (not shown in FIG. 5). Tip member 60 has a plurality of circumferentially spaced mixed gas passageways 62 that open through the front end thereof and through the rear planar surface thereof to open to bore portion 42*b* of the barrel. Further, tip member 60 has a central cutting oxygen passageway 63 that extends axially therethrough to open through the front surface thereof and through the rear end of the stem portion to open to passageway 13.

With reference to the grooves in the barrel the narrower they are, the better the flashback resistance. However, if the grooves are too narrow they do not have the desired flow capacity. Further manufacturing problems are encountered if it is attempted to provide many grooves that in transverse cross section are of a relatively great radial depth and of very narrow circumferential width. For acetylene gas it is preferred that the radial depth dimension of each groove be about 0.005–0.035 inches and the circumferential width be about 0.010–0.080 inches; and more preferrable a radial depth of 0.020–0.025 inches and a circumferential width of 0.050–0.070 inches.

With reference to the barrel annular groove portion 42*b* it is preferred that the axial height thereof is about 0.010–0.060 inches. If the axial height is too small there is increase flow resistance while if it is too great more backfiring and flashback is encountered during the use of the torch. Further, applicants have found that in testing one of the tip assemblies of the invention to intentially make the torch backfire, a much larger number of backfirings occurred without flashback than a conventional one piece torch tip made by the assignee of this application or any of the competitors' torch tips that were tested. In the conventional torch when backfiring occurred in one or more of the mixed gas passageways, a sparking action resulted from said mixed gas passageway distal opening that was caused by internal burning of mixed gases within said passageway. This condition was not readily detected by the operator in that the other mixed gas passageways still appeared to operated close to normal in the cutting operation. Continued operation of equipment in the flashback mode would result in serious damage to the same.

However, when there was a flashback in one of the mixed gas passageways of this invention, the flashback consumed all the mixed gas in bore portion 42*b* resulting in termination of mixed gas passageways 24. This caused the preheat flames on the distal end of the invention to cease thereby informing the operator that his equipment is in a flashback mode, so that he can take precautionary measures.

The grooves in the barrel can be made by broaching or drilling while the passageways in the tip front member portion are formed by drilling and then the front end part of the tip front portion is swagged in a conventional manner. The radial dimension of each of the grooves is less than corresponding dimension of cut-out 42*b*. Further, the total transverse cross sectional area of the grooves (passageways) 43 is about the same as the transverse cross sectional area of passageways 24. Testing of the invention has indicated that optimum performance occurs when the number of grooves 43 is a whole number multiple of the tip preheat passageways 24; for example 6 grooves: 6 passageways; 12 grooves: 6 passageways.

Even though the invention has been described with reference to the grooves 43 being provided in the barrel and it is preferred they be so provided, the grooves can be formed in the stem portion to open to a barrel having a circular cylindrical inner surface portion to form a close fit with the stem surface portions radially between the grooves. In such an event the grooves could extend to open to cut-out portion 42*b*. Although less preferred, instead of having cut-out portion 42*b* in the barrel an annular cut-out portion could be provided in the rear part of the front member portion solely or in conjunction with an annular cut-out in the stem portion to fluidly connect the grooved passages to mixed gas passageways 24.

What is claimed is:

1. Torch apparatus comprising a torch head having a torch head bore and cutting oxygen, preheat oxygen and fuel gas passageways opening to the torch head bore, a torch tip assembly removably extendable into the head bore and having an axially elongated central cutting oxygen bore in fluid communication with the head cutting oxygen passageway and means for removably securing the tip assembly to the torch head, the tip assembly including a torch tip member having an axially elongated stem portion extended into the bore and an axially elongated front member portion joined to the stem portion to extend away therefrom and from the torch head, said front member portion having an annular transverse rear surface surrounding the stem portion, an axially opposite front surface, and a plurality of axially elongated mixed gas passageways opening through the front member portion front surface and axially elongated annular means removably secured to the stem portion to in cooperation therewith define a plurality of axially elongated, circumferentially spaced grooved passages for conducting preheat oxygen and fuel gas and at least nearly form a fluid seal with the torch head wall defining the torch head bore axially between the openings of the torch head preheat oxygen and fuel gas passageways to the torch head bore, said annular means being in abutting relationship to the front member rear surface and having first cross bores for placing the grooved passages in fluid communication with the head fuel gas passageway and second cross bores axially spaced from the first cross bores for placing the grooved passages in fluid communication with the head preheat oxygen passageways, at least one of the stem portion, the annular means and the front member portion having an annular cut-out to define an annular fluid passageway to fluidly connect the grooved passages to the front member portion mixed gas passageways.

2. The torch apparatus of claim 1 further characterized in that the front member portion has an axially elongated central bore that extends therethrouh, in part defines a portion of the tip assembly cutting oxygen bore and in part defines a stem portion socket and that the stem portion has a front part removably extended into the front member portion socket and a bore that in part defines the tip assembly cutting oxygen bore.

3. The torch apparatus of claim 1 further characterized in that said cut-out is of an axial dimension of about 0.010–0.060 inches.

4. The torch apparatus of claim 1 further characterized in that the stem portion has an axially elongated, exterior perimetric surface portion and that the annular means comprises a barrel having an inner peripheral wall having circumferentially spaced, axially elongated first surface portions in close fitting relationship to the exterior perimetric surface portion and second surface portions circumferentially between the first surface portions defining grooves that form part of said grooved passages, said grooves opening to said perimetric surface portion.

5. The torch apparatus of claim 4 further characterized in that the stem portion has a threaded end portion axially more remote from the front member portion than the barrel and that the annular means includes a nut threaded on the threaded end portion to abut against the barrel and retain the barrel in abutting relationship to the front member portion rear surface.

6. The torch apparatus of claim 4 further characterized in that the barrel has interior wall portions defining said cut-out to open to the stem portion and the front member portion, the grooves opening to said cutout.

7. The torch apparatus of claim 4 further characterized in that mixed gas passageways open through the front member portion rear surface in radially spaced relationship to the stem portion.

8. A torch tip assembly comprising a torch tip member having a cutting oxygen bore extending axially therethrough, and including an axially elongated front member portion, and a stem portion joined to the front member portion to extend axially rearwardly thereof, the front member portion having a front surface, an annular rear surface surrounding the stem portion and a plurality of mixed gas passageways opening through the front member portion front and rear surfaces, and annular means removably mounted on the stem portion in abutting relationship with the front member portion rear surface to in cooperation with the stem portion define a plurality of circumferentially spaced, axially elongated passages for conducting preheat oxygen and fuel gas, said annular means having axially spaced preheat oxygen and fuel gas openings to said passages for respectively conducting preheat oxygen and fuel gas thereto, at least one of the stem portion, the front member portion and the annular means having a annular cut-out for conducting preheat oxygen and fuel gas from said passages to the front member portion mixed gas passageways.

9. The torch tip assembly of claim 8 further characterized in that the annular means has an axially elongated inner peripheral surface, that the stem portion has an axially elongated outer peripheral surface, and that one of said peripheral surfaces has surface portions defining axially elongated grooves that open to the other peripheral surface to in conjunction therewith define said passages and open to the cut-out.

10. The torch tip assembly of claim 9 further characterized in that the annular means comprises an axially elongated barrel having said inner peripheral surface portions that define said grooves.

11. The torch tip assembly of claim 10 further characterized in that said barrel has said cut-out.

12. The torch tip assembly of claim 10 further characterized in that said cut-out is of an axial dimension of about 0.010–0.060 inches.

13. The torch tip assembly of claim 10 further characterized in that the front member portion and stem portion have threaded portions for removably connecting the stem portion to the front member portion and that the annular means comprises a nut, the nut and stem portion having threaded portions for threading the nut on the stem portion to abut against the barrel and hold the barrel in abutting relationship to the front member portion rear surface.

14. The torch apparatus of claim 10 further characterized in that the barrel has a cross bore for each groove for fuel gas and a cross bore for each groove for preheat oxygen to respective cross bores forming said fuel gas and preheat oxygen openings.

15. The torch tip assembly of claim 10 further characterized in that the number of grooves is a whole number multiple of the number of mixed gas passageways.

* * * * *

UNITED STATES PATENT AND TRADEMARK OFFICE

CERTIFICATE OF CORRECTION

PATENT NO. : 4,383,648

DATED : 5/17/83

INVENTOR(S) : Frank C. Lunquist and Frank T. Kawamoto

It is certified that error appears in the above-identified patent and that said Letters Patent are hereby corrected as shown below:

Column 6, line 23, change "therethrouh" to --therethrough--.

Column 7, line 5, after "openings", insert --opening--.

Signed and Sealed this

Twentieth Day of September 1983

[SEAL]

*Attest:*

GERALD J. MOSSINGHOFF

*Attesting Officer*

*Commissioner of Patents and Trademarks*